US011292116B2

(12) United States Patent
Tanaka

(10) Patent No.: US 11,292,116 B2
(45) Date of Patent: Apr. 5, 2022

(54) PNEUMATIC TOOL

(71) Applicant: MAX CO., LTD., Tokyo (JP)

(72) Inventor: Hiroshi Tanaka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 175 days.

(21) Appl. No.: 16/288,799

(22) Filed: Feb. 28, 2019

(65) Prior Publication Data

US 2019/0270190 A1 Sep. 5, 2019

(30) Foreign Application Priority Data

Mar. 1, 2018 (JP) ..... JP2018-036895

(51) Int. Cl.

| | |
|---|---|
| ***B25D 9/18*** | (2006.01) |
| ***B25C 1/04*** | (2006.01) |
| ***B25D 9/08*** | (2006.01) |
| ***B25C 1/00*** | (2006.01) |
| *B25B 21/00* | (2006.01) |

(52) U.S. Cl.

CPC ..... *B25D 9/18* (2013.01); *B25C 1/00* (2013.01); *B25C 1/047* (2013.01); *B25D 9/08* (2013.01); *B25B 21/00* (2013.01)

(58) Field of Classification Search

CPC .... B25D 9/18; B25D 9/08; B25C 1/00; B25C 1/047; B25B 21/00

See application file for complete search history.

(56) References Cited

U.S. PATENT DOCUMENTS 3,106,136 A * 10/1963 Langas ..... B25C 5/16 91/417 A
3,200,716 A * 8/1965 Le Sage ..... B25C 1/041 91/461
3,407,709 A * 10/1968 Bade ..... B25C 1/047 91/461
3,572,572 A * 3/1971 Readyhough ..... B25C 1/008 227/8
4,040,164 A * 8/1977 Briles ..... B25C 1/04 29/432
4,280,248 A * 7/1981 Herubel ..... A22B 3/02 124/40

(Continued)

FOREIGN PATENT DOCUMENTS

EP 1 366 863 A2 12/2003
EP 1 955 825 A2 8/2008

(Continued)

OTHER PUBLICATIONS

European Search Report issued in Application No. 19160211.9, dated Nov. 13, 2019 (6 pages).

(Continued)

*Primary Examiner* — Nathaniel C Chukwurah
*Assistant Examiner* — Lucas E. A. Palmer
(74) *Attorney, Agent, or Firm* — Weihrouch IP

(57) ABSTRACT

A pneumatic tool includes: a drive mechanism which is configured to be driven by compressed air of a first pressure: and a valve mechanism which is configured to be actuated by compressed air of a second pressure, which is higher than an atmospheric pressure and lower than the first pressure, and which is configured to switch whether or not to supply the compressed air of the first pressure to the drive mechanism.

7 Claims, 5 Drawing Sheets

(56) References Cited

U.S. PATENT DOCUMENTS 4,717,060 A * 1/1988 Cotta ..... B25C 1/08 227/10
5,020,712 A * 6/1991 Monacelli ..... B25C 1/04 227/120
5,131,579 A * 7/1992 Okushima ..... B25C 1/008 173/210
5,370,037 A * 12/1994 Bauer ..... B25C 1/042 91/236
5,878,936 A * 3/1999 Adachi ..... B25C 1/041 227/130
6,220,496 B1 * 4/2001 Hirai ..... B25C 1/047 227/130
2004/0026477 A1 2/2004 Ishizawa et al.
2004/0238590 A1 * 12/2004 Ishizawa ..... B25C 1/046 227/130
2005/0001069 A1 1/2005 Ishizawa et al.
2005/0077064 A1 * 4/2005 Oouchi ..... B25B 21/023 173/93.5
2008/0135598 A1 * 6/2008 Burke ..... B25C 1/047 227/130
2008/0185058 A1 8/2008 Wakabayashi et al.
2010/0096428 A1 * 4/2010 Fujiyama ..... B25C 1/047 227/8
2011/0192879 A1 * 8/2011 Zhang ..... B25C 1/041 227/156
2011/0198380 A1 * 8/2011 Kitagawa ..... B25C 1/041 227/2
2011/0198384 A1 * 8/2011 Kitagawa ..... B25C 1/041 227/130
2011/0290850 A1 * 12/2011 Wu ..... B25C 1/04 227/130
2014/0110450 A1 * 4/2014 Moore ..... B25C 1/008 227/2
2015/0197001 A1 * 7/2015 Li ..... B25C 1/047 227/130
2016/0151900 A1 * 6/2016 Wu ..... B25C 1/043 227/130
2018/0117748 A1 * 5/2018 Ishikawa ..... B25C 1/06
2019/0111552 A1 * 4/2019 Nagao ..... B25C 7/00
2019/0344415 A1 * 11/2019 Furumi ..... B25C 1/047
2020/0269404 A1 * 8/2020 Tanaka ..... B25C 1/043

FOREIGN PATENT DOCUMENTS

JP S57-030474 U 2/1982
JP 2004-1136 A 1/2004
JP 2008-302442 A 12/2008
TW 260916276 A 2/1997
TW I331071 B 2/1997

OTHER PUBLICATIONS

Taiwan Office Action for corresponding TW Patent Application No. 108106701 dated Jul. 8, 2021. (6 pp.).
Japanese Office Action in corresponding JP Patent Application No. 2018-036895 dated Oct. 12, 2021 (4 pages—non English).

* cited by examiner

PNEUMATIC TOOL

CROSS-REFERENCE TO RELATED APPLICATIONS

This application is based upon and claims the benefit of priority from prior Japanese patent application No. 2018-036895, filed on Mar. 1, 2018, the entire contents of which are incorporated herein by reference.

TECHNICAL FIELD

The present invention relates to a pneumatic tool that is to be driven by compressed air.

BACKGROUND ART

A pneumatic tool referred to as a nailing machine is available in which compressed air is used as a power source to actuate a striking piston with a striking cylinder and to drive a driver joined to the striking piston, thereby striking, to a nose, a fastener such as a nail or the like supplied (for example, refer to JP-A-2008-302442)

Like this, in the pneumatic tool in which the compressed air is used as the power source, the high-pressure compressed air is used to obtain a high output. Also, in the pneumatic tool, a valve mechanism is not opened and closed by transmitting mechanical movement to the valve mechanism but the valve mechanism is opened by using a pneumatic pressure and a force of a spring, thereby improving an actuating speed of the valve mechanism.

Patent Document 1: JP-A-2008-302442

In the pneumatic tool of the related art, the valve mechanism is actuated by the high-pressure compressed air, which is the same as the compressed air to be supplied to a drive source. For this reason, the high pneumatic pressure is applied to the valve mechanism, so that a sliding resistance and an operating load are high upon actuation of the valve mechanism, and the actuating speed of the valve mechanism is thus lowered.

An aspect of the present invention relates to provide a pneumatic tool capable of reducing a load resulting from a pneumatic pressure.

SUMMARY OF INVENTION

According to the present invention, there is provided a pneumatic tool comprising: a drive mechanism which is configured to be driven by compressed air of a first pressure; and a valve mechanism which is configured to be actuated by compressed air of a second pressure, which is higher than an atmospheric pressure and lower than the first pressure, and which is configured to switch whether or not to supply the compressed air of the first pressure to the drive mechanism.

DESCRIPTION OF EMBODIMENTS

Hereinafter, exemplary embodiments of a nailing machine as a striking tool, which is an example of the pneumatic tool of the present invention, will be described with reference to the drawings.

<Configuration Example of Nailing Machine of First Exemplary Embodiment>

Figure 1:
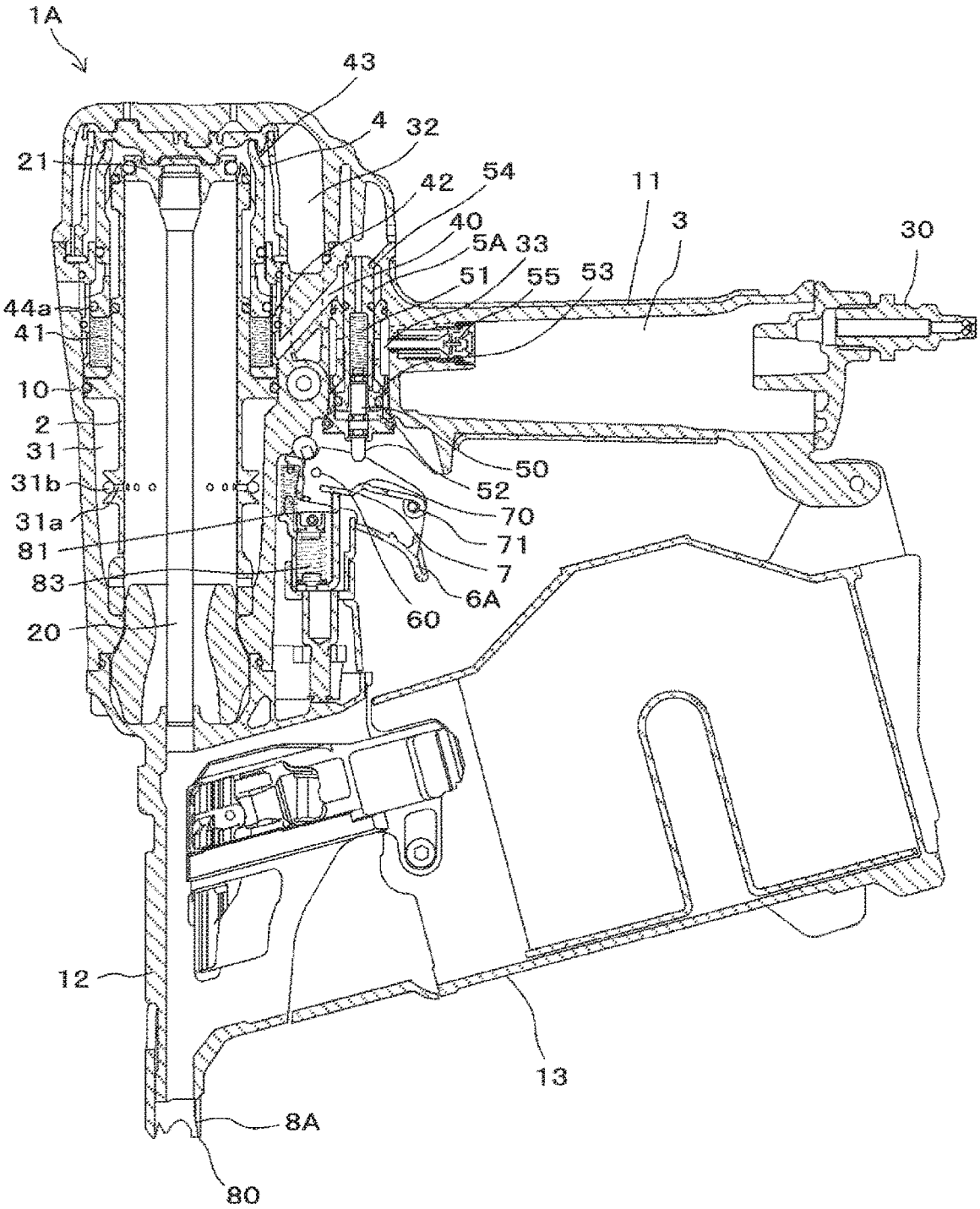
FIG. 1 is a configuration view of main parts depicting an example of a nailing machine of a first exemplary embodiment.

FIG. 1 is a configuration view of main parts depicting an example of a nailing machine of a first exemplary embodiment.

A nailing machine 1A of the first exemplary embodiment includes a striking cylinder 2 configured to be actuated by compressed air as a fluid, which is a power source, and to perform a striking operation, and an air chamber 3 in which compressed air to be supplied from an external air compressor (not shown) is to be stored. In the nailing machine 1A, the striking cylinder 2 is provided in a housing 10 extending in one direction, and the air chamber 3 is provided in a handle 11 extending in the other direction from the housing 10. Also, the nailing machine 1A has a blowback chamber 31 provided around a lower part of the striking cylinder 2 in the housing 10.

The striking cylinder 2 is an example of the drive mechanism, and includes a driver 20 configured to strike out a nail and the like (not shoxwn) and a striking piston 21 to which the driver 20 is provided, and the striking piston 21 is slidably provided. The striking cylinder 2 is configured so that as the striking piston 21 is pressed with the compressed air, the striking piston 21 is moved to drive the driver 20.

Into the air chamber 3, the compressed air is supplied from a compressed air source such as an air compressor, via an air plug 30 that is an example of an intake port provided to an end portion of the handle 11. The blowback chamber 31 is supplied with the compressed air so as to return the striking piston 21 to an initial position after a striking operation. The blowback chamber 31 is coupled to the striking cylinder 2 through an inlet/outlet 31*a*. In the inlet/outlet 31*a*, a check valve 31*b* configured to restrain an air flowing direction to one direction is provided. The check valve 31*b* is configured to allow the air to flow from the striking cylinder 2 into the blowback chamber 31 and to restrain the air from flowing back from the blowback chamber 31 to the striking cylinder 2.

The nailing machine 1A has a nose 12, in which the driver 20 is to enter, provided at one end portion of the housing 10, and a magazine 13 configured to supply a nail (not shown) to the nose 12. The nose 12 extends along a moving direction of the driver 20. In the meantime, considering a using aspect of the nailing machine 1A, a side at which the nose 12 is provided is set to face downward.

The nailing machine 1A includes a main valve 4 configured to reciprocally move the striking piston 21 by restraining inflow/outflow of the compressed air in the air chamber 3, and an activation valve 5A configured to actuate the main valve 4. Also, the nailing machine 1A includes a decompression valve 55 configured to supply decompressed compressed air to the main valve 4 and the activation valve 5A. The decompression valve 55 is an example of the decompression mechanism, is provided in the handle 11, and is configured to decompress the compressed air of a first pressure supplied to the air chamber 3 to a second pressure lower than the first pressure and higher than an atmospheric pressure, and configured to supply the same to the activation valve 5A.

The compressed air of the first pressure is compressed air of which a pressure is set to an appropriate drive value for actuating the striking cylinder 2, and the compressed air of the second pressure is compressed air of which a pressure is set to an appropriate control value for actuating the main valve 4 and the activation valve 5A. In the below, the compressed air of the first pressure is referred to as 'high-pressure compressed air', and the compressed air of the second pressure is referred to as 'low-pressure compressed air'.

The nailing machine 1A has a high-pressure air flow path 32, which is a first air flow path through which the high-pressure compressed air to be supplied from the air chamber 3 to the striking cylinder 2 is to pass, and a low-pressure air flow path 33, which is a second air flow path through which the low-pressure compressed air to be supplied from the air chamber 3 to the activation valve 5A through the decompression valve 55 is to pass.

The main valve 4 is an example of the valve mechanism, and is configured to reciprocally move the striking piston 21 by switching inflow of the high-pressure compressed air from the air chamber 3 into the striking cylinder 2 and discharge of the high-pressure compressed air from the striking cylinder 2 to an outside.

The main valve 4 is provided to be vertically moveable to an outer periphery-side of an upper end portion of the striking cylinder 2. Also, the main valve 4 is urged upward, which is a closing direction, by a force of a spring 41. Also, as the low-pressure compressed air decompressed by the decompression valve 55 is supplied to a lower chamber 42 via the activation valve 5A, the main valve 4 is pushed upward by a pneumatic pressure of the low-pressure compressed air. Thereby, during non-actuation, the main valve 4 is urged upward by the force of the spring 41 and the pneumatic pressure and is thus located at a top dead center, thereby closing upper end openings of the air chamber 3 and the striking cylinder 2.

The activation valve 5A is an example of the valve mechanism, is provided to be vertically moveable to the handle 11, and is urged upward, which is a closing direction, by a force of a spring 51. Also, as the low-pressure compressed air decompressed by the decompression valve 55 is supplied to a lower chamber 52, the activation valve 5A is pushed upward by the pneumatic pressure of the low-pressure compressed air.

The activation valve 5A has a valve stem 50 provided to be reciprocally moveable. The valve stem 50 is provided to be vertically moveable to the activation valve 5A, and is urged downward by the force of the spring 51. Also, as the low-pressure compressed air decompressed by the decompression valve 55 is supplied, the valve stem 50 is urged downward by the pneumatic pressure of the low-pressure compressed air.

The nailing machine 1A includes a trigger 6A configured to receive one operation for actuating the activation valve 5A, a contact arm 8A configured to move as another operation for pressing to a material to be struck, into which a nail is to be struck, is received, and a contact lever 7 configured to be actuated by an operation of the trigger 6A having received one operation and an operation of the contact arm 8A having received another operation, and to switch whether or not to actuate the activation valve 5A.

The trigger 6A is provided at one side of the handle 11, at which the nose 12 is provided. The trigger 6A is rotatably supported at one end portion, which is a side close to the housing 10, by a shaft 60. Also, the trigger 6A is urged by a spring in a direction in which a side opposite to the side supported by the shaft 60, i.e., the other end portion-side distant from the housing 10 is to move toward the side, at which the nose 12 is provided, by a rotating operation of which a support point is the shaft 60.

The contact lever 7 is provided at one end portion with an acting part 70 capable of pushing the valve stem 50 of the activation valve 5A, and is rotatably supported at the other end portion to the trigger 6A by a shaft 71. Also, the contact lever 7 is urged by a spring such as a coil spring in a direction in which a side opposite to the side supported by the shaft 71, i.e., one end portion-side, at which the acting part 70 is provided, is to move toward the side, at which the nose 12 is provided, by a rotating operation of which a support point is the shaft 71.

The contact arm 8A is provided to be moveable along the extension direction of the nose 12, and is provided at a tip end-side of the nose 12 with a butting part 80 that is to be butted to the material to be struck. Also, the contact arm 8A has a pressing part 81 for actuating the contact lever 7. The contact arm 8A is urged in a direction protruding from the tip end-side of the nose 12 by a spring 83.

As the butting part 80 is butted and pushed to the material to be struck, the contact arm 8A is moved from an initial position to an actuation position at which the contact lever 7 is to be actuated by the pressing part 81.

The contact lever 7 is pushed to the contact arm 8A, so that the contact lever is moved from an initial position to an operable position, at which the valve stem 50 is pushed to actuate the activation valve 5A, by the rotating operation of which a support point is the shaft 71.

In a state where an operation is released, the trigger 6A is moved to an initial position by the rotating operation of which a support point is the shaft 60. By a pulling operation, the trigger 6A is moved from the initial position to an operation position, at which the activation valve 5A can be actuated by the contact lever 7 having moved to the operable position, by the rotating operation of which a support point is the shaft 60.

<Operation Example of Nailing Machine of First Exemplary Embodiment>

Subsequently, operations of the nailing machine 1A of the first exemplary embodiment are described with reference to the respective drawings.

In an initial state, as shown in FIG. 1, the trigger 6A is not pulled yet and is located at the initial position, and the contact arm 8A is not pressed yet to the material to be struck and is located at the initial position. For this reason, the contact lever 7 is also located at the initial position.

When the contact arm 8A is pressed to the material to be struck from the initial state shown in FIG. 1 and the contact arm 8A is thus moved from the initial position to the actuation position, the pressing part 81 of the contact arm 8A pushes the contact lever 7. Thereby, the contact lever 7 is moved from the initial position to the operable position, at which the valve stem 50 is pushed to actuate the activation valve 5A, by the rotating operation of which a support point is the shaft 71. In the meantime, when the trigger 6A is not moved to the operation position even though the contact lever 7 is moved to the operable position, the valve stem 50 is not pushed by the contact lever 7.

After the contact arm 8A is pressed to the material to be struck from the initial state and is thus moved to the actuation position, when the trigger 6A is pulled and is thus moved from the initial position to the operation position, the acting part 70 of the contact lever 7 located at the operable position pushes the valve stem 50 of the activation valve 5A.

The valve stem 50 of the activation valve 5A is moved upward by a predetermined amount, so that the low-pressure compressed air in the lower chamber 52 is exhausted. When the low-pressure compressed air in the lower chamber 52 is exhausted, the pneumatic pressure applied to an acting surface 53 of the activation valve 5A becomes higher than the force of the spring 51, so that the activation valve 5A is moved downward to open the flow path 40.

When the flow path 40 is opened, the low-pressure compressed air in the lower chamber 42 of the main valve 4 is exhausted. Therefore, the pneumatic pressure applied to an acting surface 43 of the main valve 4 becomes higher than the force of the spring 41, so that the main valve 4 is moved downward. Thereby, the high-pressure compressed air in the air chamber 3 is supplied to the striking cylinder 2.

Thereby, the striking cylinder 2 is actuated by the high-pressure compressed air, so that the striking piston 21 is moved in the direction of striking out a fastener (not shown), in this example, a nail, and the nail (not shown) is struck by the driver 20. Also, a part of the air in the striking cylinder 2 is supplied from the inlet/outlet 31*a* to the blowback chamber 31. After the striking operation, the compressed air is supplied from the blowback chamber 31 to the striking cylinder 2, so that the striking piston 21 is moved in the direction of returning the driver 20.

<Operational Effect Example of Nailing Machine of First Exemplary Embodiment>

Figure 2:
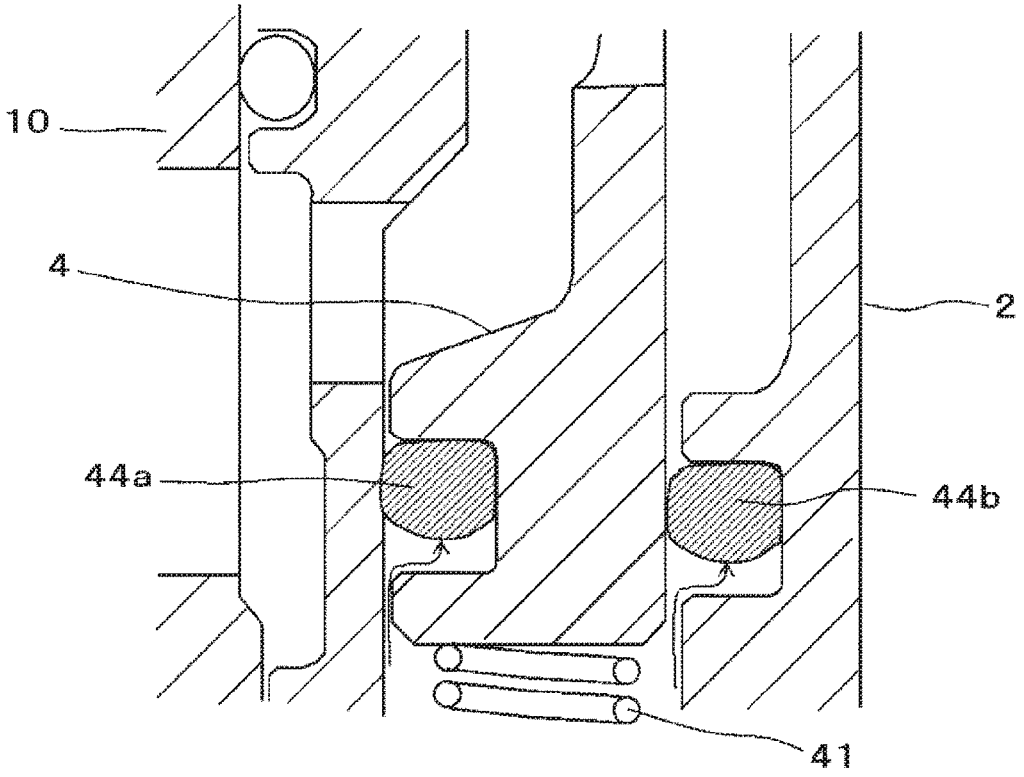
FIG. 2 is a view illustrating a problem that occurs when a main valve is actuated with high-pressure compressed air.
Figure 3:
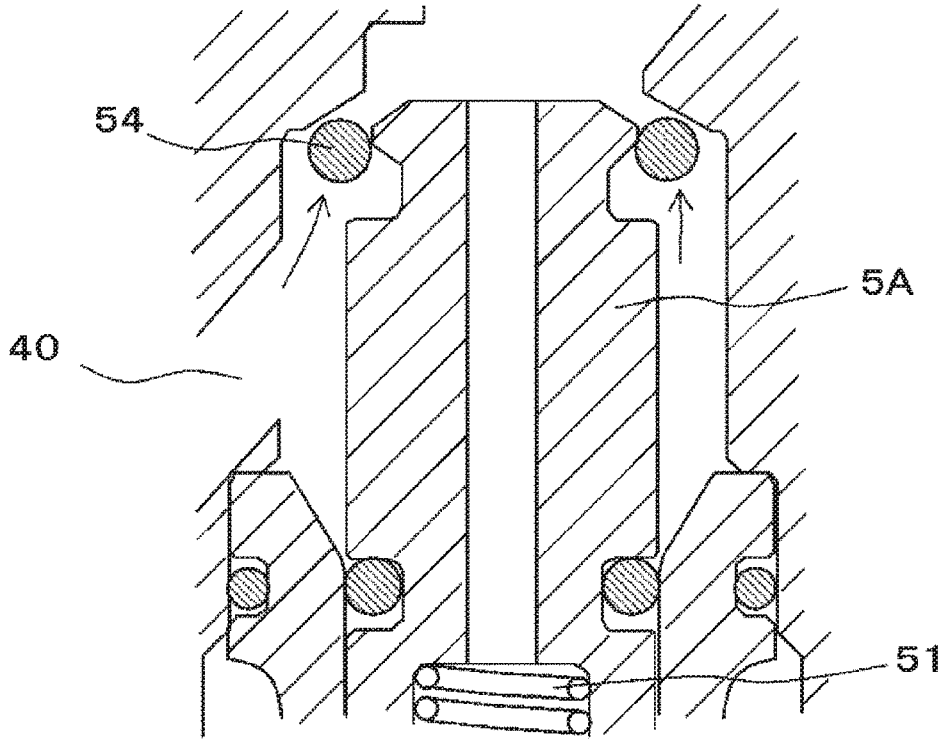
FIG. 3 is a view illustrating a problem that occurs when an activation valve is actuated with the high-pressure compressed air.

FIG. 2 is a view illustrating a problem that occurs when the main valve is actuated with the high-pressure compressed air, and FIG. 3 is a view illustrating a problem that occurs when the activation valve is actuated with the high-pressure compressed air.

In the striking tool such as the nailing machine 1A in which the compressed air is used as a power source, the high-pressure compressed air is used to obtain the high output. To this end, the high-pressure compressed air is supplied from the air compressor. Also, in the striking tool, the main valve is not opened and closed by transmitting mechanically movement of the trigger to the main valve but the main valve is opened at higher speed by using the pneumatic pressure and the force of a spring, as compared to a human operation.

To this end, the activation valve 5A and the main valve 4 are also supplied with the compressed air. However, in the related art, the high-pressure compressed air for actuating the striking cylinder 2 is directly supplied from the air chamber 3 to the activation valve 5A.

In a configuration where the high-pressure compressed air, which is the same as the compressed air to be supplied to the striking cylinder 2, is supplied to the lower chamber 42 of the main valve 4, the high pneumatic pressure is applied to a sealing member 44*a* such as an O-ring for sealing the lower chamber 42 and a sealing member 44*b* for sealing the main valve 4, as shown in FIG. 2.

Thereby, amounts of deformation of the sealing members 44*a*. 44*b* increase, so that the pressing force to be applied to the main valve 4 by the sealing members 44*a*, 44*b* increases. For this reason, a sliding resistance increases upon actuation of the main valve 4, so that the operating speed of the main valve 4 is lowered and the responsiveness is deteriorated.

In contrast, in a configuration where the compressed air, which is higher than the atmospheric pressure and is lower than the compressed air to be supplied to the striking cylinder 2, is supplied to the lower chamber 42 of the main valve 4, the pneumatic pressure that is applied to the sealing member 44*a* such as an O-ring for sealing the lower chamber 42 and the sealing member 44*b* for sealing the main valve 4 is lower than the high-pressure compressed air.

Thereby, the amounts of deformation of the sealing members 44*a*, 44*b* are suppressed, so that the pressing force to be applied to the main valve 4 by the sealing members 44*a*, 44*b* decreases. For this reason, the increase in sliding resistance upon actuation of the main valve 4 is suppressed, so that the operating speed of the main valve 4 is suppressed and the responsiveness is improved.

Also, in the configuration where the high-pressure compressed air, which is the same as the compressed air to be supplied to the striking cylinder 2, is supplied to the lower chamber 42 of the main valve 4, when the activation valve 5A is opened, the high-pressure compressed air flows through the flow path 40, so that the high pneumatic pressure is applied to a sealing member 54 of the activation valve 5A, such as an O-ring exposed to the flow path 40, as shown in FIG. 3. Thereby, the sealing member 54 may be separated from the activation valve 5A.

In contrast, in the configuration where the compressed air, which is higher than the atmospheric pressure and is lower than the compressed air to be supplied to the striking cylinder 2, is supplied to the lower chamber 42 of the main valve 4, the activation valve 5A is opened, so that the pneumatic pressure, which is applied to the sealing member 54 of the activation valve 5A such as an O-ring exposed to the flow path 40, becomes lower than the high-pressure compressed air. Thereby, the sealing member 54 is suppressed from being separated from the activation valve 5A.

Figure 4:
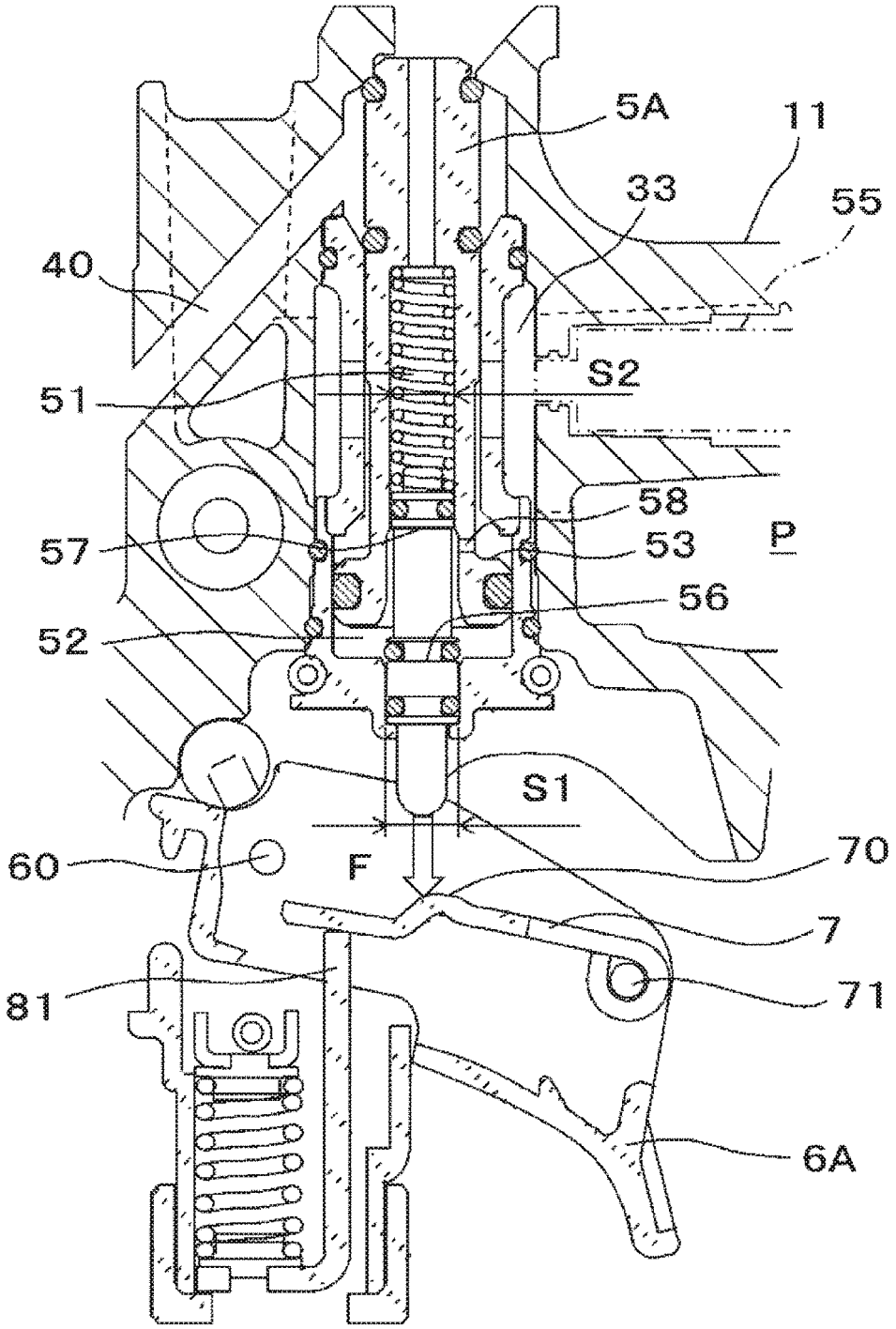
FIG. 4 is a view illustrating an effect when the activation valve is actuated with low-pressure compressed air.

FIG. 4 is a view illustrating an effect when the activation valve is actuated with the low-pressure compressed air. The activation valve 5A is actuated by a difference between areas of a first pressure receiving surface 56 and a second pressure receiving surface 57 on which the valve stem 50 receives the pneumatic pressure./

That is, when the compressed air is supplied to an actuation chamber 58 through the activation valve 5A, the pneumatic pressure is applied to both the first pressure receiving surface 56 and the second pressure receiving surface 57 of the valve stem 50. Since the area of the first pressure receiving surface 56 is larger than the area of the second pressure receiving surface 57, the valve stem 50 is moved in a direction in which the valve stem 50 protrudes from the activation valve 5A.

When the pneumatic pressure applied to the valve stem 50 is denoted with P, the area of the first pressure receiving surface 56 is denoted with S1 and the area of the second pressure receiving surface 57 is denoted with S2, the force F by which the valve stem 50 is moved is expressed by a following equation (1).

$$F=(S1-S2)\times P \quad (1)$$

In a configuration where the valve stem 50 is actuated by the difference between the areas of the first pressure receiving surface 56 and the second pressure receiving surface 57, it is possible to lower the force F by which the valve stem 50 is moved, from the above equation (1). On the other hand, in the configuration where the high-pressure compressed air, which is the same as the compressed air to be supplied to the striking cylinder 2, is supplied to the valve stem 50, since the force F by which the valve stem 50 is moved has a value obtained by multiplying the difference between the areas of the first pressure receiving surface 56 and the second pressure receiving surface 57 by the pneumatic pressure, the operating load by which the valve stem 50 is pushed via the trigger 6A increases.

In contrast, in the configuration where the compressed air, which is higher than the atmospheric pressure and is lower than the compressed air to be supplied to the striking cylinder 2, is supplied to the valve stem 50, the force F by which the valve stem 50 is moved is reduced, so that the operating load by which the valve stem 50 is pushed via the trigger 6A is reduced.

In the meantime, even in a configuration where the valve stem receives the pneumatic pressure with a single pressure receiving surface, the similar effect is obtained.

<Configuration Example of Nailing Machine of Second Exemplary Embodiment>

Figure 5:
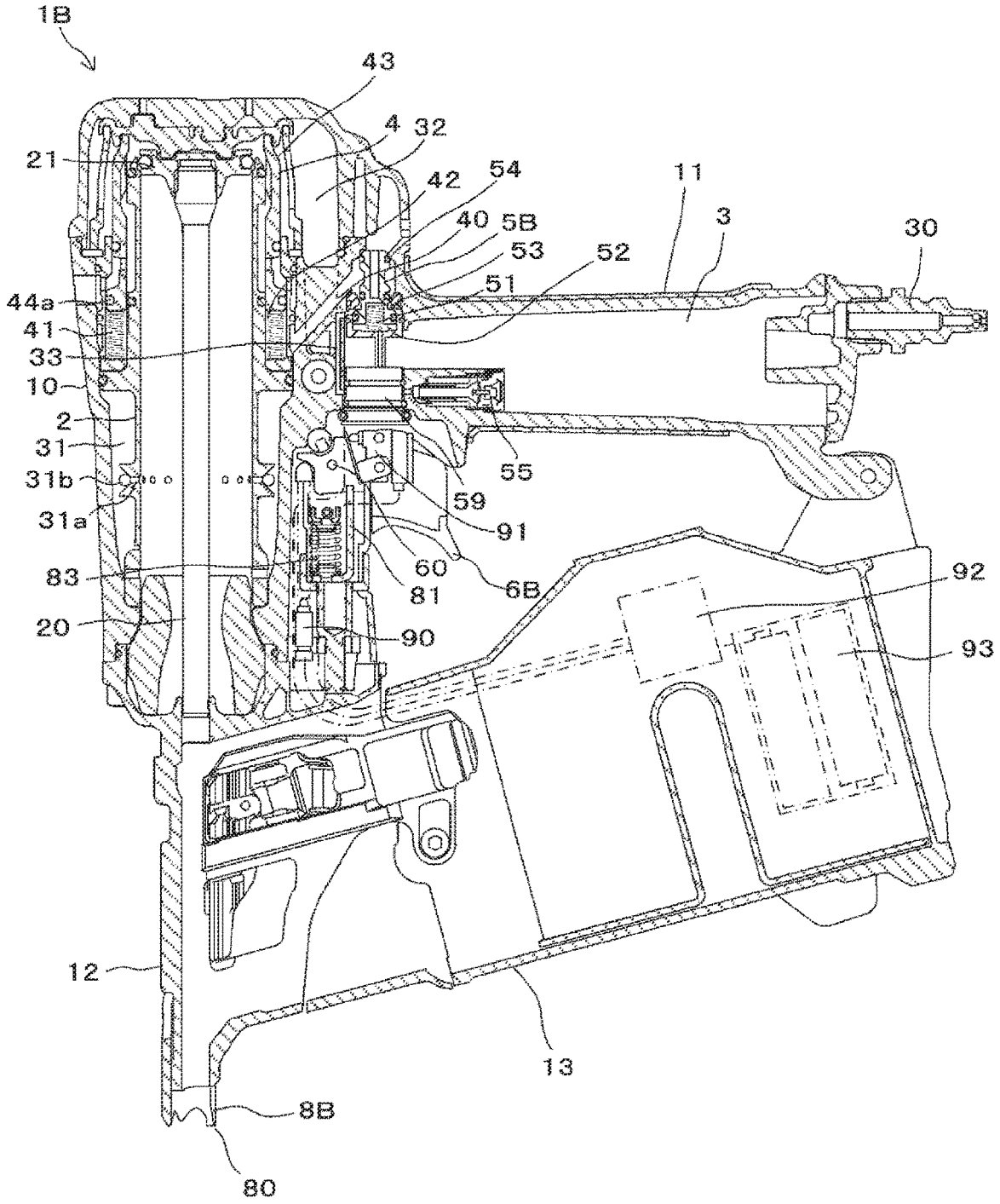
FIG. 5 is a configuration view of main parts depicting an example of a nailing machine of a second exemplary embodiment.

FIG. 5 is a configuration view of main parts depicting an example of a nailing machine of a second exemplary embodiment.

A nailing machine 1B of the second exemplary embodiment includes a striking cylinder 2 configured to be actuated by compressed air as a fluid, which is a power source, and to perform a striking operation, and an air chamber 3 in which compressed air to be supplied from an external air compressor (not shown) is to be stored. In the nailing machine 1B, the striking cylinder 2 is provided in a housing 10 extending in one direction, and the air chamber 3 is provided in a handle 11 extending in the other direction from the housing 10. Also, the nailing machine 1B has a blowback chamber 31 provided around a lower part of the striking cylinder 2 in the housing 10.

The striking cylinder 2 that is a drive mechanism includes a driver 20 configured to strike out a nail and the like (not shown) and a striking piston 21 to which the driver 20 is provided, and the striking piston 21 is slidably provided. The striking cylinder 2 is configured so that as the striking piston 21 is pressed with the compressed air, the striking piston 21 is moved to drive the driver 20.

Into the air chamber 3, the compressed air is supplied from compressed air source such as an air compressor, via an air plug 30 that is an intake port provided to an end portion of the handle 11. The blowback chamber 31 is supplied with the compressed air so as to return the striking piston 21 to an initial position after a striking operation. The blowback chamber 31 is coupled to the striking cylinder 2 through an inlet/outlet 31*a*. In the inlet/outlet 31*a*, a check valve 31*b* configured to restrain an air flowing direction to one direction is provided. The check valve 31*b* is configured to allow the air to flow from the striking cylinder 2 into the blowback chamber 31 and to restrain the air from flowing back from the blowback chamber 31 to the striking cylinder 2.

The nailing machine 1B has a nose 12, in which the driver 20 is to enter, provided at one end portion of the housing 10, and a magazine 13 configured to supply a nail (not shown) to the nose 12. The nose 12 extends along a moving direction of the driver 20. In the meantime, considering a using aspect of the nailing machine 1B, a side at which the nose 12 is provided is set to face downward.

The nailing machine 1B includes a main valve 4 configured to reciprocally move the striking piston 21 by restraining inflow/outflow of the compressed air in the air chamber 3, and an activation valve 5B configured to actuate the main valve 4. Also, the nailing machine 1B includes a decompression valve 55 configured to supply decompressed compressed air to the main valve 4 and the activation valve 5B. The decompression valve 55 that is a decompression mechanism is provided in the handle 11, and is configured to decompress the compressed air of a first pressure supplied to the air chamber 3 to a second pressure lower than the first pressure and higher than an atmospheric pressure, and configured to supply the same to the activation valve 5B.

The compressed air of the first pressure is compressed air of which a pressure is set to an appropriate drive value for actuating the striking cylinder 2, and the compressed air of the second pressure is compressed air of which a pressure is set to an appropriate control value for actuating the main valve 4 and the activation valve 5B. In the below, the compressed air of the first pressure is referred to as 'high-pressure compressed air', and the compressed air of the second pressure is referred to as 'low-pressure compressed air'.

The nailing machine 1B has a high-pressure air flow path 32, which is a first air flow path through which the high-pressure compressed air to be supplied from the air chamber 3 to the striking cylinder 2 is to pass, and a low-pressure air flow path 33, which is a second air flow path through which the low-pressure compressed air to be supplied from the air chamber 3 to the activation valve 5B through the decompression valve 55 is to pass.

The main valve 4 that is a valve mechanism is configured to reciprocally move the striking piston 21 by switching inflow of the high-pressure compressed air from the air chamber 3 into the striking cylinder 2 and discharge of the high-pressure compressed air from the striking cylinder 2 to an outside.

The main valve 4 is provided to be vertically moveable to an outer periphery-side of an upper end portion of the striking cylinder 2. Also, the main valve 4 is urged upward, which is a closing direction, by a force of a spring 41. Also, as the low-pressure compressed air decompressed by the decompression valve 55 is supplied to a lower chamber 42 via the activation valve 5B, the main valve 4 is pushed upward by a pneumatic pressure of the low-pressure compressed air. Thereby, during non-actuation, the main valve 4 is urged upward by the force of the spring 41 and the pneumatic pressure and is thus located at a top dead center, thereby closing upper end openings of the air chamber 3 and the striking cylinder 2.

The activation valve 5B is an example of the valve mechanism, is provided to be vertically moveable to the handle 11, and is urged upward, which is a closing direction, by a force of a spring 51. Also, as the low-pressure compressed air decompressed by the decompression valve 55 is supplied to a lower chamber 52, the activation valve 5B is pushed upward by the pneumatic pressure of the low-pressure compressed air.

The nailing machine 1B includes an electromagnetic valve 59 configured to actuate the activation valve 5B. The electromagnetic valve 59 is an example of the electromagnetic valve, and is configured to actuate the activation valve 5B by opening and closing the lower chamber 52 of the activation valve 5B to control the flow of the low-pressure compressed air.

The nailing machine 1B includes a trigger 6B configured to receive one operation for actuating the activation valve 5B, and a contact arm 8B configured to move as another operation for pressing to a material to be struck, into which a nail is to be struck, is received.

The trigger 6B is provided at one side of the handle 11, at which the nose 12 is provided. The trigger 6B is rotatably supported at one end portion, which is a side close to the housing 10, by a shaft 60. Also, the trigger 6B is urged by a spring in a direction in which a side opposite to the side supported by the shaft 60, i.e., the other end portion-side distant from the housing 10 is to move toward the side, at which the nose 12 is provided, by a rotating operation of which a support point is the shaft 60.

The contact arm 8B is provided to be moveable along the extension direction of the nose 12, and is provided at a tip end-side of the nose 12 with a butting part 80 that is to be butted to the material to be struck. Also, the contact arm 8B is urged in a direction protruding from the tip end-side of the nose 12 by a spring 83.

The nailing machine 1B has a first switch 90 configured to be actuated by an operation of the trigger 6B and a second switch 91 configured to be actuated by an operation of the contact arm 8B. Also, the nailing machine 1B includes a control unit 92 configured to actuate the electromagnetic valve 59, depending on whether the first switch 90 and the second switch 91 are operated, and a power supply unit 93 such as a battery configured to feed power to the control unit 92 and the like.

As the butting part 80 is butted and pushed to the material to be struck, the contact arm 8B is moved from an initial position to an actuation position at which the second switch 91 is to be actuated by the pressing part 81.

In a state where an operation is released, the trigger 6B is moved to an initial position by the rotating operation of which a support point is the shaft 60. By a pulling operation, the trigger 6B is moved from an initial position to an operation position, at which the first switch 90 can be actuated, by the rotating operation of which a support point is the shaft 60.

<Operation Example of Nailing Machine of Second Exemplary Embodiment>

Subsequently, operations of the nailing machine 1B of the second exemplary embodiment are described with reference to the respective drawings.

In an initial state, as shown in FIG. 5, the trigger 6B is not pulled yet and is located at the initial position, and the contact arm 8B is not pressed yet to the material to be struck and is located at the initial position. For this reason, both the first switch 90 and the second switch 91 are in a non-actuation state. The non-actuation state of the first switch 90 is denoted as OFF, and the non-actuation state of the second switch 91 is denoted as OFF.

When the contact arm 8B is pressed to the material to be struck from the initial state shown in FIG. 5 and the contact arm 8B is thus moved from the initial position to the actuation position, the second switch 91 is pushed by the pressing part 81, so that the second switch 91 is actuated and becomes ON.

After the contact arm 8B is pressed to the material to be struck from the initial state and is thus moved to the actuation position, when the trigger 6B is pulled and is thus moved from the initial position to the operation position, the first switch 90 is actuated and becomes ON. When the first switch 90 becomes ON in a state where the second switch 91 is ON, the control unit 92 actuates the electromagnetic valve 59. That is, when the trigger 6B is operated and is thus moved to the operation position in a state where the contact arm 8B is pressed to the material to be struck and is thus moved to the actuation position, the electromagnetic valve 59 is actuated. In contrast, even when the trigger 6B is first operated and is thus moved to the operation position to make the first switch 90 be ON and then the contact arm 8B is pressed to the material to be struck and is thus moved to the actuation position to make the second switch 91 be ON, the electromagnetic valve 59 is not actuated.

When the electromagnetic valve 59 is actuated, the low-pressure compressed air in the lower chamber 52 is exhausted. When the low-pressure compressed air in the lower chamber 52 is exhausted, the pneumatic pressure applied to an acting surface 53 of the activation valve 5B becomes higher than the force of the spring 51, so that the activation valve 5B is moved downward to open the flow path 40.

When the flow path 40 is opened, the low-pressure compressed air in the lower chamber 42 of the main valve 4 is exhausted. Therefore, the pneumatic pressure applied to an acting surface 43 of the main valve 4 becomes higher than the force of the spring 41, so that the main valve 4 is moved downward. Thereby, the high-pressure compressed air in the air chamber 3 is supplied to the striking cylinder 2.

Thereby, the striking cylinder 2 is actuated by the high-pressure compressed air, so that the striking piston 21 is moved in the direction of striking out a fastener (not shown), in this example, a nail, and the nail (not shown) is struck by the driver 20. Also, a part of the air in the striking cylinder 2 is supplied from the inlet/outlet 31*a* to the blowback chamber 31. After the striking operation, the compressed air is supplied from the blowback chamber 31 to the striking cylinder 2, so that the striking piston 21 is moved in the direction of returning the driver 20.

<Operational Effect Example of Nailing Machine of Second Exemplary Embodiment>

In a configuration where the activation valve 5B is actuated by the electromagnetic valve 59 and the high-pressure compressed air, which is the same as the compressed air to be supplied to the striking cylinder 2, is supplied to the activation valve 5B, since the high-pressure compressed air is supplied to the lower chamber 52, it is necessary that the electromagnetic valve 59 configured to open and close the lower chamber 52 can seal the high-pressure compressed air. For this reason, the high force is required so as to actuate the electromagnetic valve 59, so that the device becomes larger and the power consumption increases.

In contrast, in the configuration where the compressed air, which is higher than the atmospheric pressure and is lower than the compressed air to be supplied to the striking cylinder 2, is supplied to the lower chamber 52 of the activation valve 5B, it is possible to reduce the force for actuating the electromagnetic valve 59, so that it is possible to make the device small and to save the power consumption.

In the nailing machine 1B of the second exemplary embodiment, since it is possible to actuate the electromagnetic valve 59, irrespective of whether the trigger is operated, the present invention can be applied to a standing nailing machine, too.

In the meantime, in the nailing machine 1A of the first exemplary embodiment and the nailing machine 1B of the second exemplary embodiment, the decompression valve 55 is embedded in the handle 11. However, the nailing machine 1A of the first exemplary embodiment and the nailing machine 1B of the second exemplary embodiment may not be provided with the decompression valve 55 inasmuch as the high-pressure compressed air and the low-pressure compressed air are supplied from the air compressor. A configuration where the decompression valve is provided between the nailing machine 1A of the first exemplary embodiment and the nailing machine 1B of the second exemplary embodiment and the air compressor and the high-pressure compressed air to be supplied from the air compressor is branched into the high-pressure compressed air and the low-pressure compressed air is also possible.

According to the present invention, there is provided a pneumatic tool comprising: a drive mechanism which is configured to be driven by compressed air of a first pressure; and a valve mechanism which is configured to be actuated by compressed air of a second pressure, which is higher than an atmospheric pressure and lower than the first pressure, and which is configured to switch whether or not to supply the compressed air of the first pressure to the drive mechanism.

In the present invention, the valve mechanism is actuated by the switching of supply and exhaust of the compressed air of the second pressure, and the valve mechanism is actuated, so that the compressed air of the first pressure is supplied to the drive mechanism.

According to the present invention, the drive mechanism can be driven by the compressed air of the first pressure suitable for drive of the drive mechanism, thereby obtaining a desired output. Also, since the valve mechanism is actuated with the second pressure lower than the first pressure, the pneumatic pressure that is to be applied to the valve mechanism is reduced, and the sliding resistance and the operating load upon the actuation are reduced, so that the load resulting from the pneumatic pressure is reduced. Therefore, it is possible to improve the actuating speed of the valve mechanism.

The present invention is applied to a tool that is used with being gripped by a human hand, such as a nailing machine and a screwing machine, the other pneumatic tool, and a standing pneumatic tool.

What is claimed is:

1. A pneumatic tool comprising:

a drive mechanism which is configured to be driven by compressed air of a first pressure;

a decompression mechanism which is configured to decompress the compressed air of the first pressure to generate the compressed air of a second pressure;

a first air flow path through which the compressed air of the first pressure is supplied to the drive mechanism;

a valve mechanism which is configured to be actuated by compressed air of the second pressure, which is higher than an atmospheric pressure and lower than the first pressure, and which is configured to switch whether or not to supply the compressed air of the first pressure to the drive mechanism; and a second air flow path which branches from the first air flow path on an upstream side of the drive mechanism, through which the compressed air of the second pressure is supplied from the decompression mechanism to the valve mechanism.

2. The pneumatic tool according to claim 1, wherein the decompression mechanism is provided between an intake port through which the compressed air of the first pressure is to be supplied and the valve mechanism.

3. The pneumatic tool according to claim 2, further comprising:

a handle which is to be gripped by a hand, wherein the handle is provided with the intake port and the decompression mechanism.

4. The pneumatic tool according to claim 1, further comprising:

an electromagnetic valve which is configured to control flow of the compressed air of the second pressure, thereby actuating the valve mechanism.

5. The pneumatic tool according to claim 1, further comprising:

an electromagnetic valve which is configured to control flow of the compressed air of the second pressure, thereby actuating the valve mechanism.

6. A pneumatic tool comprising:

a drive mechanism which is configured to be driven by compressed air of a first pressure;

a decompression mechanism which is configured to decompress the compressed air of the first pressure to generate the compressed air of a second pressure;

a first air flow path through which the compressed air of the first pressure is supplied to the drive mechanism;

a valve mechanism which is vertically moveable to an outer periphery-side of an upper end portion of the drive mechanism; and a second air flow path which branches from the first air flow path on an upstream side of the drive mechanism, through which the compressed air of the second pressure is supplied from the decompression mechanism to the valve mechanism, wherein the valve mechanism is configured to be actuated by compressed air of a second pressure, which is higher than an atmospheric pressure and lower than the first pressure, and is configured to switch whether or not to supply the compressed air of the first pressure to the drive mechanism.

7. A pneumatic tool comprising:

a drive mechanism which is configured to be driven by compressed air of a first pressure;

a decompression mechanism which is configured to decompress the compressed air of the first pressure to generate the compressed air of a second pressure;

a first air flow path through which the compressed air of the first pressure is supplied to the drive mechanism;

a main valve which is configured to switch whether or not to supply the compressed air of the first pressure to the drive mechanism;

an activation valve which is configured to actuate the main valve and a second air flow path which branches from the first air flow path on an upstream side of the drive mechanism, through which the compressed air of the second pressure is supplied from the decompression mechanism to the activation valve, wherein the activation valve controls a flow path of a second pressure, which is higher than an atmospheric pressure and lower than the first pressure.

* * * * *